US005613772A

United States Patent [19]

Sawyer

[11] Patent Number: 5,613,772

[45] Date of Patent: Mar. 25, 1997

[54] FINIAL ADAPTER FOR CLIP-ON LAMP SHADES

[76] Inventor: Gerald F. Sawyer, 2862 Tree Top Rd., Dacula, Ga. 30211

[21] Appl. No.: 761,483

[22] Filed: Sep. 18, 1991

[51] Int. Cl.[6] ..... F21V 17/04

[52] U.S. Cl. ..... 362/444; 362/356; 362/457; 428/28

[58] Field of Search ..... 362/355, 356, 362/357, 358, 444, 445, 457, 458, 806; 428/28

[56] References Cited

U.S. PATENT DOCUMENTS 2,121,575 6/1936 Shoemaker ..... 362/358 X 2,997,576 8/1961 Heitshu ..... 362/356

4,498,125 2/1985 Schumaker ..... 362/356 X

*Primary Examiner*—Stephen F. Husar

*Attorney, Agent, or Firm*—James B. Middleton

[57] ABSTRACT

A finial adapter is selectively fixable to the wire of a clip-on lamp shade to allow use of a finial on clip-on lamp shades. Centrally of the plate, feet automatically center the adapter into the appropriate position to attach to the wire. The adapter has a plate having an upwardly extending stud to receive the finial, and downwardly extending tabs to engage the wires on the shade. Wire spreaders separate the wires of the shade and urge the wires into locking contact with the tabs. Centrally of the plate, feet extending down to surround the washer of the clip for the shade to center the finial adapter on the shade.

10 Claims, 1 Drawing Sheet

Fig. 1
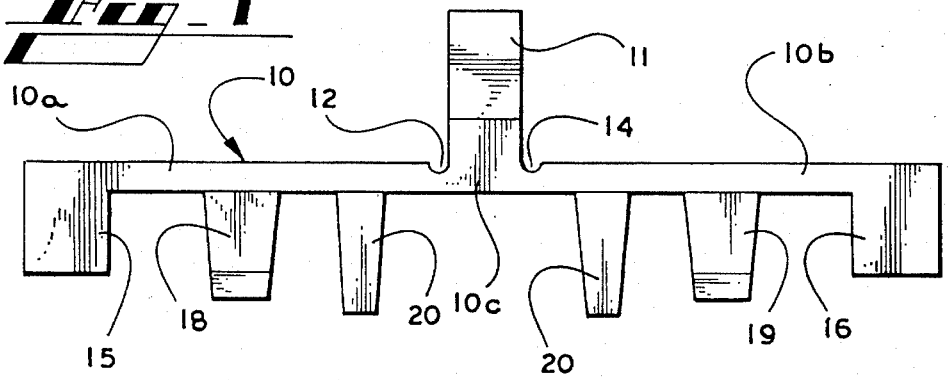
Fig. 2
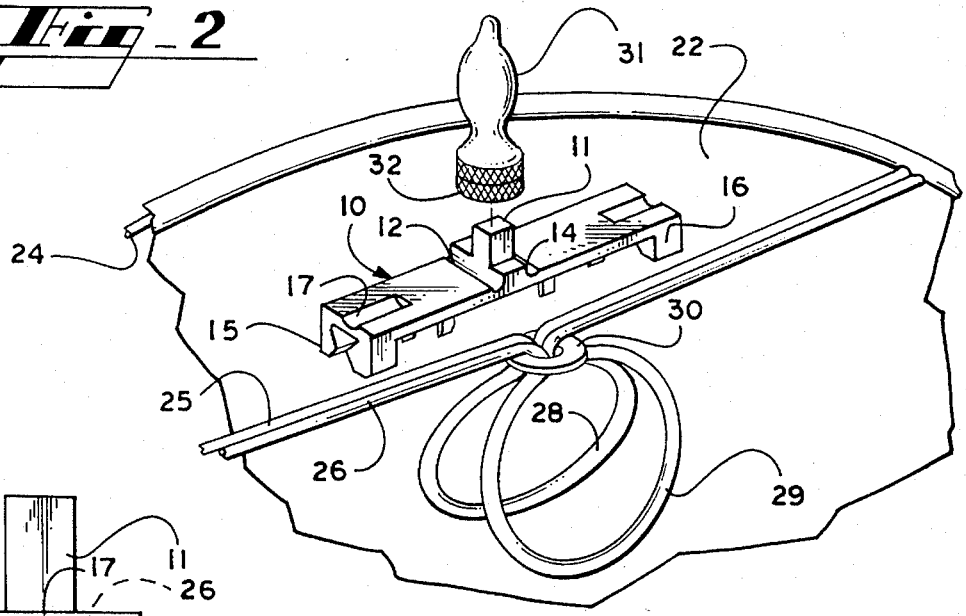
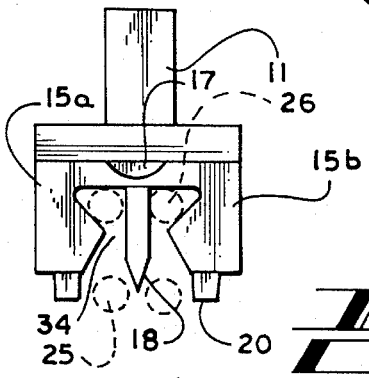
Fig. 3
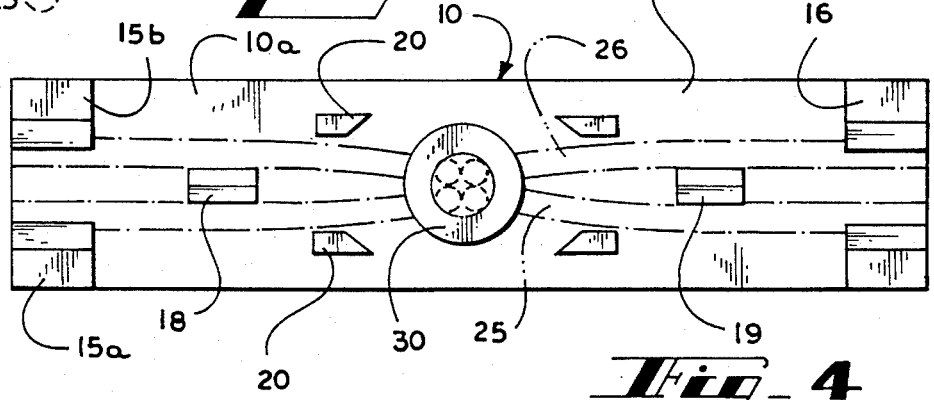
Fig. 4

FINIAL ADAPTER FOR CLIP-ON LAMP SHADES

INFORMATION DISCLOSURE STATEMENT

A large number of lamps utilize a lamp shade support carried by the lamp and extending around the light bulb, such supports being referred to as harps. The upper end of the harp then supports the lamp shade. The lamp shade is conventionally fastened to the upper end of the harp by a threaded member on the harp over which the lampshade washer is placed and held in position by a lamp finial, the finial being frequently a decorative member. Though the threaded finial base usually serves a utilitarian purpose, finials are typically very decorative items, and are selected to complement the appearance of the lamp.

Because of the decorating nature of finials for lamps, finials have become very desirable; however, finials are usable only on lamps that have a harp for supporting the lamp shade. It is presently conventional to provide harps no smaller than about six inches high. As a result, smaller lamps do not use harps, and generally cannot use finials. These smaller lamps include small decorative lamps, small boudoir lamps, some chandeliers and others.

When there is no harp on the lamp, the shade is usually supported by a bulb clip or a flame clip. The clip comprises loops of wire for resiliently engaging the light bulb in a lamp, the loops of wire being carried by wires extending generally diametrically across the lamp shade. In the usual clip-on shade, the clip is integral with the diametrically extending wires, and there is nothing to which a finial can be attached.

SUMMARY OF THE INVENTION

This invention relates generally to lamp shades, and is more particularly concerned with a finial adapter to provide a finial support on a clip-on lamp shade.

The present invention provides an adapter selectively fixable to the diametrical wires of a clip-on lamp shade. The adapter comprises a plate member disposable on the wires, and securing means extending from the plate member for releasably securing the plate member to the wires. A finial holding means extends from the plate member for receiving a finial thereon.

BRIEF DESCRIPTION OF THE DRAWINGS

These and other features and advantages of the present invention will become apparent from consideration of the following specification when taken in conjunction with the accompanying drawings in which:

FIG. 1 is a front elevational view of a finial adapter made in accordance with the present invention;

FIG. 2 is an exploded perspective view showing the finial adapter of FIG. 1 in conjunction with a bulb clip shade and a finial;

FIG. 3 is an end elevational view of the finial adapter shown in FIG. 1; and, FIG. 4 is a bottom plan view of the finial adapter shown in FIGS. 1–3.

DETAILED DESCRIPTION OF THE EMBODIMENT

Referring now more particularly to the drawings, and to that embodiment of the invention here presented by way of illustration, the device shown in FIG. 1 includes a plate member 10 which is designed to extend along the diametrically extending wires of a clip-on shade. Generally centrally of the plate member 10 there is a finial support 11. It will be noticed that the plate member 10 has two sections 10*a* and 10*b* connected to the central section 10*c* by hinges 12 and 14. Though the hinges 12 and 14 may not be required, those skilled in the art will understand that some shades will have support wires that slope downwardly to the clip. With such a shade, the plate member 10 will need to be bent to conform to the wire, and the hinges 12 and 14 allow such bending.

At the outer ends of the plate member 10 there are tabs 15 and 16 for securing the plate member 10 to the wires of the shade. These tabs will be discussed in more detail hereinafter. Inwardly of the tabs 15 and 16 there are wire spreaders 18 and 19 which cooperate with the tabs 15 and 16 to lock the plate member 10 to the wires of the lamp shade.

In the typical clip-on lamp shade, there is a wire that extends around the top of the lamp shade forming a hoop at the top of the lamp shade. The diametrically extending wires then act as spokes of the hoop, and the spring clip is centrally of the hoop, carried by the spokes. With such an arrangement, it will be understood that the wires making up the spokes are not necessarily precisely parallel. As a result, it is necessary to align and add tension to the wires with the wire spreaders 18 and 19. Four feet 20 that extend down from the plate member 10 serve to center the adapter on the wire in the proper position by placing the feet 20 around the cinch or ring 30 that holds the wire together above the wire clip that clamps around the bulb.

Attention is next directed to FIG. 2 of the drawings. In FIG. 2 there is shown a lamp shade 22 having the wire hoop 24 around the upper edge. Diametrically extending wires 25 and 26 have clip members 28 and 29 formed integrally therewith. A washer 30 or other ligation means holds the wires 25 and 26 together so the clamping of the clip members 28 and 29 will be effective.

The adapter of the present invention is shown in position to be received on the wires 25 and 26. In FIG. 2 it will be seen that there are two tabs 15 and two tabs 16 so that one tab extends on each side of the wires 25 and 26 to secure the plate member 10 to the wires 25 and 26.

It will also be observed that the finial support 11 is simply a square post, whereas the conventional finial 31 includes a finial base 32 having an internally threaded bore to be received on a threaded stud. The square post 11 of the present invention is sized so the diagonal of the post is substantially equal to the major diameter of the threaded bore. Further, the post 11 will be made of a plastic or other somewhat deformable material so the finial base 32 can be screwed onto the post 11, forming its own threads. The finial support, or post, may therefore also be sometimes referred to as a stud.

FIG. 3 of the drawings is an end view of the finial adapter of the present invention, and well illustrates the means for fixing the adapter to the wires 25 and 26. It will be seen that the tabs 15 include front and rear tabs 15*a* and 15*b* which define an hourglass opening therebetween for providing a restriction 34. Also, the wire spreader 18 can be seen beyond the tabs 15*a* and 15*b*. It will therefore be understood that, as the adapter is placed over the wires 25 and 26, the wire spreaders 18 and 19 will extend between the wires to separate them. Meanwhile, the wires will be urged between the tabs 15*a* and 15*b* and guided towards the restriction 34. With additional force, the wires 25 and 26 will snap past the restriction 34 and to the upper portion of the space between the tabs 15*a* and 15*b*. At this point, one portion of the wires 25 and 26 is held apart by the wire spreaders 18 and another portion of the wires is held together by the tabs 15*a* and 15*b*. FIG. 4 of the drawings illustrates the wires in relation to the present device, the wires being shown in phantom.

In the area of the tabs 15*a* and 15*b*, the plate member 10 defines a notch 17. The notch 17 is designed to allow the plate member 10 to bend somewhat, which allows the tabs 15*a* and 15*b* to hinge with respect to each other. As a result, rather thick wires can be passed through the restriction 34, the plate member 10 bending to allow needed separation of the tabs 15*a* and 15*b*.

Those skilled in the art will realize that the wires 25 and 26 vary in thickness. If the tabs 15 and 16 are inflexible, one may require a variety of adapters to fit the various shades. By allowing some hinging of the tabs 15*a* and 15*b* with respect to each other, a range of wire sizes can be accommodated. Thus, a single adapter made in accordance with the present invention can be used on any clip-on shade currently manufactured.

One of the advantages of the arrangement shown and described is the fact that the wires 25 and 26 are urged apart by the wire spreaders 18 and 19, and the wires are thereby held in engagement with the upper portion of the hourglass shape between the tabs 15*a* and 15*b*. This provides a secure hold. Also, since the wires 25 and 26 are laterally separated, the wires tend to become horizontally side by side. The feet 20 will be disposed around the washer 30 which assures that the device is centered. Thus, the plate member is horizontal and centered, and the stud 11 is vertically disposed.

With the above description in mind, operation of the device should be understandable. A bulb clip-on shade will be selected, and the adapter of the present invention will be placed generally centrally of the diametrical wires 25 and 26. The plate member 10 will be urged down, causing the wire separators 18 and 19 to extend between the wires, while the wires are directed between the tabs such as the tabs 15*a* and 15*b*. The wires 25 and 26 will snap past the restriction 34, and will then be held in place because of the separation of the wires. The feet 20 will surround the ring 30 to assure proper centering of the device. The hinges 12, 14, and 17 will allow necessary bending of the plate member to allow use of the device on a variety of shades.

Those skilled in the art will recognize that the device of the present invention may be made of any of numerous materials. If the device is made of brass or the like, the hinge means will be rather complex and the device will be quite expensive. It is therefore contemplated that the device of the present invention will be made of a plastic material so the hinges can be molded into an integrally formed product as shown in the drawings.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A finial adapter for a clip-on lamp shade, said shade including diametrically extending wires, and clamping members generally centrally of said wires, said adapter comprising a finial support for selectively receiving a finial thereon, a plate member carrying said finial support, and means for selectively fixing said plate member to said wires.

2. A finial adapter as claimed in claim 1, said means for selectively fixing said plate member to said wires including opposed tabs for engaging opposite sides of said wires.

3. A finial adapter as claimed in claim 2, said diametrically extending wires comprising a pair of wires, said adapter further including wire spreading means for separating said pair of wires, the arrangement being such that said wires are urged against said tabs.

4. A finial adapter as claimed in claim 3, and including hinge means for allowing said tabs to hinge with respect to each other.

5. A finial adapter as claimed in claim 4, wherein said plate member comprises a first section and a second section, and hinge means for allowing said first section and said second section to pivot with respect to each other.

6. A finial adapter as claimed in claim 1, and further including a plurality of feet extending downwardly from said plate member centrally thereof.

7. A finial adapter as claimed in claim 6, said finial support comprising a rectangular post having a diagonal substantially equal to the major diameter of the threaded bore of the finial.

8. A device for providing a finial on a table lamp having a metal hoop-type lampshade which is releasable secured to said lamp by a pair of opposed spring clips which grip a lightbulb held in said lamp, said spring clips being connected to said hoop of said lampshade by spokes, comprising:

(a) a plate member;

(b) wire securing means extending from said plate member for releasably securing said plate member to said spokes said wire securing means comprising a pair of opposed tabs which selectively grip and release said spoke wires; and (c) said plate member having finial holding means for a finial.

9. A device as claimed in claim 8 wherein said wire securing means is formed from a flexible and resilient material.

10. A device as claimed in claim 8, wherein said tabs have spoke locking means to releasably secure said tabs and said device to said spokes.

* * * * *